US005628172A

United States Patent [19]

Kolmes et al.

[11] Patent Number: 5,628,172

[45] Date of Patent: May 13, 1997

[54] COMPOSITE YARNS FOR PROTECTIVE GARMENTS

[75] Inventors: Nathaniel H. Kolmes, 1740 5th St. Dr. NW., Hickory, N.C. 28601; Harold F. Plemmons, 50 Seagate Dr., Unit 1203B, Naples, Fla. 33940

[73] Assignees: Nathaniel H. Kolmes, Hickory, N.C.; Harold F. Plemmons, Naples, Fla.

[21] Appl. No.: 299,206

[22] Filed: Aug. 31, 1994

[51] Int. Cl.[6] ..... D02G 3/02; D02G 3/36

[52] U.S. Cl. ..... 57/210; 2/167; 57/229; 57/230

[58] Field of Search ..... 57/210, 229, 230, 57/902; 2/167, 161.7

[56] References Cited

U.S. PATENT DOCUMENTS

| | | | |
|---|---|---|---|
| 1,853,543 | 4/1932 | Bradford . | |
| 2,335,644 | 11/1943 | Camp | 57/140 |
| 2,342,098 | 2/1944 | Alderfer | 57/152 |
| 2,573,361 | 10/1951 | Rogers et al. | 64/2 |
| 3,026,669 | 3/1962 | Stanton | 57/140 |
| 3,145,525 | 8/1964 | Laureti | 57/140 |
| 3,155,768 | 11/1964 | Garshick | 174/101.5 |
| 3,265,809 | 8/1966 | Morieras | 174/101.5 |
| 3,315,455 | 4/1967 | Stoller | 57/144 |
| 3,472,289 | 10/1969 | Webber et al. | 139/425 |
| 3,490,224 | 1/1970 | Bourgeas | 57/140 |
| 3,601,970 | 8/1971 | Roberts | 57/153 |
| 4,074,512 | 2/1978 | Matt | 57/140 |
| 4,274,448 | 6/1981 | Westhead | 139/383 |
| 4,321,854 | 3/1982 | Foote et al. | 87/6 |
| 4,384,449 | 5/1983 | Byrnes et al. | 57/210 |
| 4,470,251 | 9/1984 | Bettcher | 57/230 |
| 4,776,160 | 10/1988 | Rees | 57/210 |
| 4,777,789 | 10/1988 | Kolmes et al. | 57/210 |
| 4,838,017 | 6/1989 | Kolmes et al. | 57/210 |
| 4,936,085 | 6/1990 | Kolmes et al. | 57/210 |
| 4,967,548 | 11/1990 | Fangeat et al. | 57/224 |
| 5,177,948 | 1/1993 | Kolmes et al. | 57/229 |

FOREIGN PATENT DOCUMENTS

| | | |
|---|---|---|
| 2643914 | 9/1990 | France . |
| 2222912 | 3/1990 | United Kingdom . |

*Primary Examiner*—William Stryjewski

*Attorney, Agent, or Firm*—Rhodes, Coats & Bennett, L.L.P.

[57] ABSTRACT

Composite yarns having a total diameter of less than about 0.013 inch and a denier not exceeding 625 are formed with a first core strand formed of either an extended chain polyethylene, an aramid, or a liquid crystal polymer having a denier in the range of 70–200 or a nylon, polyester, or polycotton having a denier in the range of 40–70; a second core strand of fiberglass having a denier of 75–125; and at least one covering strand having a denier of 40–100; and protective garments, such as glove liners, having improved cut and puncture resistance produced therefrom.

7 Claims, 1 Drawing Sheet

COMPOSITE YARNS FOR PROTECTIVE GARMENTS

BACKGROUND OF THE INVENTION (1) Field of the Invention

The present invention relates to non-metallic, composite yarns useful in the manufacture of protective garments, such as cut and puncture resistant glove liners to be worn by doctors, dentists, nurses and other healthcare personnel beneath latex gloves.

(2) Description of the Prior Art

Latex gloves are commonly worn by healthcare personnel as barrier protection against diseases carried by a patient's blood and other body fluids. Use of this protection has become particularly critical with the advent of AIDS.

Unfortunately, latex gloves do not provide any protection against cuts or needle punctures which occasionally occur. These cuts and punctures are especially hazardous during surgery, since body fluids can enter the glove and the user's body through the cut or puncture created.

To address this problem, it has been suggested that medical personnel should wear cut-resistant safety gloves beneath the latex gloves. Safety gloves, which were originally designed to be worn by meat cutters, sheet metal workers, and the like, have proven to be unsuitable for use by healthcare personnel, however, since they are bulky, eliminate tactile sensation, and impede delicate manipulations required by healthcare personnel in the performance of their duties.

Examples of patents describing safety gloves exhibiting cut-resistant characteristics, and composite yarns used in the manufacture of such gloves, include U.S. Pat. No. 4,384,449 to Byrnes et al, which describes gloves manufactured from a composite yarn having a first core strand of wire which preferably has a diameter of from about 0.004 inch to about 0.006 inch, a second core strand of an aramid, and two covering strands of an aramid. The aramid strands have deniers of from about 200 to about 1500, preferably 200 to 400.

U.S. Pat. No. 4,470,251 to Bettcher describes safety gloves manufactured with a similar composite yarn; namely, a yarn having two core strands of annealed stainless steel wire, one core strand of an aramid, one covering strand of an aramid and one covering strand of nylon. The steel wire has a diameter of from 0.002 to 0.006 inch, and the aramid strand has a denier of from 500 to 1100 in the core strand and 400 in the covering strand.

Safety gloves are also described in U.S. Pat. Nos. 4,777,789 and 4,838,017 to Kolmes et al. The gloves described in these patents are prepared using a composite yarn having one or more core strands of an extended-chain polyethylene such as Spectra, manufactured by Allied-Signal, Inc., a core strand of wire having a diameter of 0.003 to 0.006 inch, and one or more covering strands of Spectra, nylon or other fiber which has a denier of 200 to 1500.

Gloves described in U.S. Pat. No. 4,936,085 to Kolmes et al, are manufactured with a composite yarn having at least one core strand of fiberglass, and at least two covering strands, one of which is fiberglass. The fiberglass has a denier in the range of from about 185 to about 2000, with a range of 375 to 1000 being preferred for the core and a range of 500 to 1000 being preferred for the covering. The preferred total denier of the yarn is in the range of about 3000 to about 6000.

U.S. Pat. No. 5,177,948 to Kolmes et al, which is a continuation-in-part of the application leading to U.S. Pat. No. 4,936,085, further discloses that the non fiberglass fibers may include Spectra or an aramid.

In addition to conventional safety gloves of the type described in the aforesaid patents, surgical glove liners have also been knitted using 100% Spectra fibers. There is still a need, however, for a more lightweight, smaller composite yarn strand that exhibits cut-resistant properties. This yearn may be used, for example, to form glove liners beneath surgical gloves. Such glove liners must afford a high degree of flexibility and allow a maximum degree of finger dexterity. Yet such glove liners must exhibit a high degree of cut and puncture resistance.

SUMMARY OF THE INVENTION

The present invention relates to such new and improved composite yarns, which may be used to form such items as surgical glove liners and other protective garments which are manufactured utilizing these improved yarns.

Surprisingly, it has been discovered that it is possible to produce highly desirable composite yarns from materials similar to those described in the preceding prior art, but with strand diameters and/or yarn deniers substantially less than those contemplated or recommended in the prior art disclosures.

The resultant composite yarns, due to their smaller diameters, can be knit on much finer gauge knitting machinery, i.e., a 13 gauge knitting machine, as opposed to a 5 or 7 gauge machine, to produce a tightly knit fabric which is resistant to cuts and punctures. Protective garments, e.g., glove liners, formed from this fabric are far superior to garments formed from prior art composite yarns, since they are much thinner and more flexible, thus affording a greater tactile sensation, and permitting the user to engage in more delicate manipulations.

Specifically, the composite yarns of the present invention comprise a first core strand formed of fibers or filaments selected from the group consisting of an extended-chain polyethylene, such as Spectra (manufactured by Allied-Signal, Inc.) formed into a 70–200 denier yarn; an aramid, such as Kevlar (manufactured by DuPont de Nemours), a liquid crystal polymer fiber such as Vectran (manufactured by Hoescht Celanese) formed into a 70–200 denier yarn; nylon formed into a 40–70 denier yarn, polyester formed into a 40–70 denier yarn, and polycotton formed into a 40–70 denier yarn. A second core strand is made of fiberglass having a denier of from about 75 to about 125. An inner covering strand is made of the materials used for the first core yarn except having a denier in the range of from about 40 to 100. An outer wrap or covering strand is formed similar to the inner wrap and is wrapped in the opposite direction. Yarns produced with these three strands will have a total denier of from about 375 to about 625, since the covering wrap is coiled around the core fibers instead of extending in a straight line. The diameter of the composite yarn described herein is 0.008 to 0.013 inch.

Gloves manufactured from this yarn are particularly useful during surgery since they are non-conductive and do not carry any risk of wire breakage. In addition, glove liners formed of the composite yarn herein described exhibits superior characteristics as far as washability, longevity, and knittability than other glove liners.

As used herein, the term "strand" is intended to include wire, and continuous filament and staple yarns.

DESCRIPTION OF THE PREFERRED EMBODIMENTS

Figure 2:
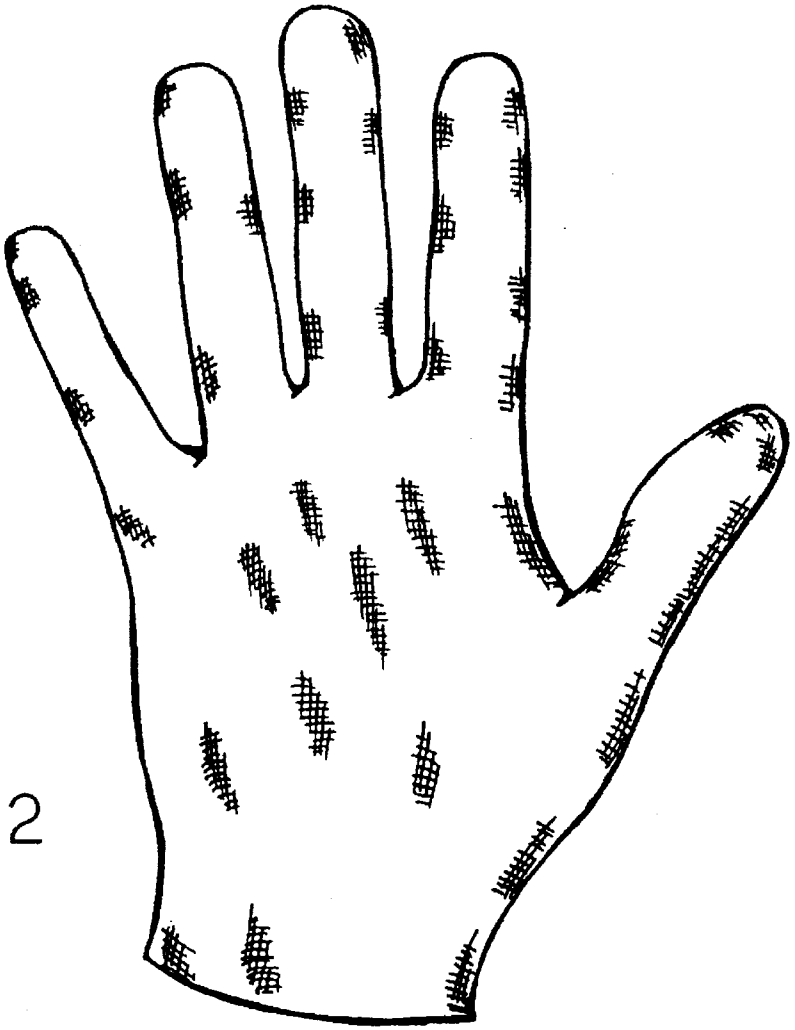
FIG. 2 is illustrative of a glove liner forming a part of the present invention, and made utilizing a yarn described herein.
Figure 1:
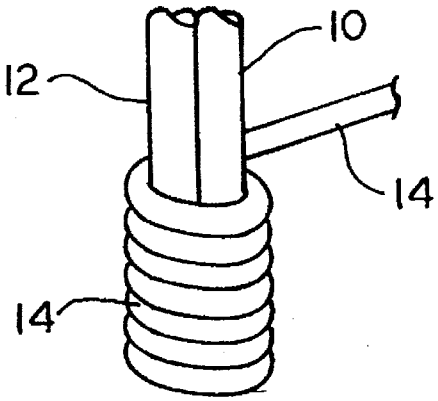
FIG. 1 is illustrative of a composite yarn within the scope of the present invention.

The yarn illustrated in FIG. 1, is comprised of a first core strand 10 having a denier of from about 70–200 in the case of Spectra, Kevlar, or Vertran and 40 to about 70 in the case of nylon, polyester, or polycotton, a second core strand 12 of fiberglass having a denier of from about 75 to about 125, and one or more covering strands 14 having a denier of from about 40 to about 100, wrapped around core strands 10 and 12.

Core strand 10 may be formed from a high strength yarn or a more conventional yarn. Examples of fibers used to form the high strength yarn include an extended-chain polyethylene, such as Spectra, manufactured by Allied-Signal, Inc.; an aramid, such as Kevlar manufactured by DuPont de Nemours; or a liquid crystal polymer fibre, such as Vectran manufactured by Hoechst Celanese. Examples of the fibers or filaments for the conventional yarns include nylon, polyester, and polycotton. The high strength yarns should have a denier in the range of 70–200 and the conventional yarns may be lighter, in the range of 40–70 denier. The covering strand(s) may be formed from the same fibers as the first core strand in the indicated range of denier.

The composite yarns of the present invention may be formed on a standard hollow spindle covering machine with the coverings or wrappings being at the rate of from 18 to 22 turns per inch in an inner wrap, and from 16 to 20 turns per inch in an outer wrap.

The deniers of the core and covering strands used in preparing specific composite yarns should be selected so that the total diameter of the composite yarn is less than about 0.013 inch, in order for the yarn to be knittable on a 13 gauge knitting machine. Preferably, the composite yarn will have a diameter of from about 0.008 to about 0.013 inch.

In the preceding detailed description, certain specific terminology has been employed for the sake of clarity and particular embodiments described in accordance with 35 U.S.C. §112, but it is to be understood that the same is not intended to be limiting and should not be so construed in as much as the invention is capable of taking many forms and variations within the scope of the appended claims.

For example, additional core and wrap yarns can be used with the yarns shown and described, and multiple strands can be used, so long as the total diameter of the composite yarn does not exceed 0.013 inch, which permits knitting on a 13 gauge knitting machine. The covering strand, while shown wrapped in one direction, can be wrapped in the other direction.

Furthermore, it will be apparent that the composite yarns of the present invention are useful in the manufacture of other articles, such as light-weight safety gloves to be worn without latex gloves, or in the production of various types of body armor. Also, the yarns described herein may be used to manufacture woven articles.

What is claimed is:

1. A composite, cut-resistant yarn comprising:

(a) a first core strand being formed of fibers or filaments selected from the group consisting of an extended-chain polyethylene formed into a 70–200 denier yarn, an aramid formed into 70–200 denier yarn, a liquid crystal polymer formed into a 70–200 denier yarn, nylon formed into a 40–70 denier yarn, polyester formed into a 40–70 denier yarn, and polycotton formed into a 40–70 denier yarn;

(b) a second core strand of fiberglass having a denier of from about 75 to about 125;

(c) at least one covering strand having a denier of from about 40 to about 100, said covering strand being formed of fibers or filaments selected from the group consisting of extended-chain polyethylene, aramid, liquid crystal polymer, nylon, polyester, and polycotton; and (d) the diameter of said composite yarn not exceeding 0.013 inch.

2. The composite yarn of claim 1, having a total denier of no more than 625.

3. The yarn of claim 1, wherein said covering strand is wrapped about said core strands at the rate of from about 18 to about 22 turns per inch.

4. A knitted, cut and puncture resistant, glove liner suitable for use beneath latex gloves, said glove liner being formed from a composite yarn comprising:

(a) a first core strand being formed of fibers or filaments selected from the group consisting of an extended-chain polyethylene formed into a 70–200 denier yarn, an aramid formed into 70–200 denier yarn, a liquid crystal polymer formed into a 70–200 denier yarn, nylon formed into a 40–70 denier yarn, and polycotton formed into a 40–70 denier yarn;

(b) a second core strand of fiberglass having a denier of from about 75 to about 125;

(c) at least one covering strand having a denier of from about 40 to about 100, said covering strand being formed of fibers or filaments selected from a group consisting of extended-chain polyethylene, aramid, liquid crystal polymer, nylon, polyester, and polycotton;

(d) the diameter of said composite yarn not exceeding 0.013 inch; and (e) the total denier of said composite yarn not exceeding 625.

5. The glove liner of claim 4 wherein said liner is formed on a 13 gauge knitting machine.

6. A protective fabric knitted from a composite, cut-resistant yarn, said composite, cut-resistant yarn comprising:

(a) a first core strand being formed of fibers or filaments selected from the group consisting of an extended-chain polyethylene formed into a 70–200 denier yarn, an aramid formed into 70–200 denier yarn, a liquid crystal polymer formed into a 70–200 denier yarn, nylon formed into a 40–70 denier yarn, polyester formed into a 40–70 denier yarn, and polycotton formed into a 40–70 denier yarn;

(b) a second core strand of fiberglass having a denier of from about 75 to about 125;

(c) at least one covering strand having a denier of from about 40 to about 100, said covering strand being formed of fibers or filaments selected from the group consisting of extended-chain polyethylene, aramid, liquid crystal polymer, nylon, polyester, and polycotton; and (d) the diameter of said composite yarn not exceeding 0.013 inch.

7. The fabric according to claim 6 wherein said composite yarn is formed into said fabric by knitting on a 13 gauge knitting machine.

* * * * *